United States Patent [19]

Horn et al.

[11] 3,998,085

[45] Dec. 21, 1976

[54] ELEVATOR BUCKET SHAPE RESTORATION TOOL

[75] Inventors: Charles L. Horn; Clifford B. Persinger, both of Covington, Va.

[73] Assignee: Westvaco Corporation, New York, N.Y.

[22] Filed: Mar. 19, 1976

[21] Appl. No.: 668,539

[52] U.S. Cl. ..... 72/316; 72/447; 113/120 DD

[51] Int. Cl.[2] ..... B21D 1/10

[58] Field of Search ... 113/120 M, 120 BB, 120 DD; 72/316, 447, 462

[56] References Cited

UNITED STATES PATENTS

| | | | |
|---|---|---|---|
| 3,064,709 | 11/1962 | Deacon | 72/316 |
| 3,065,780 | 11/1962 | Romak | 72/316 |

*Primary Examiner*—Lowell A. Larson

*Attorney, Agent, or Firm*—W. Allen Marcontell; Richard L. Schmalz

[57] ABSTRACT

Misshapen elevator lift buckets are reformed without removal from the carrier belt by means of a linear motor socketed on a press bracket that is pivotally secured to the bucket mounting fasteners. Upon expansion of the linear motor, a distorted bucket drag lip is pressed back to substantially correct position.

4 Claims, 5 Drawing Figures

ELEVATOR BUCKET SHAPE RESTORATION TOOL

BACKGROUND OF THE INVENTION

1. Field of the Invention

The present invention relates to industrial equipment repair tools. More specifically, the present invention relates to tools for reshaping elevator buckets which have been distorted by normal use.

2. Description of the Prior Art

A series of elevator buckets attached around the periphery of an endless conveyor belt is a commonly used apparatus for movement of loose, particulate matter such as gravel, bark or sawdust. Often, the movement course of such buckets is arranged whereby the buckets dig into a mound of the material to be moved. When working with raw, natural materials of the class described, inevitably an object will be encountered that damages one or more buckets by drawing and stretching the bucket lip to the extent that it will not pick up and hold the intended quantity of material.

Regardless of whatever removable fastener type is used to attach such buckets to the carrier belt, the fastener usually becomes damaged in normal use to such a degree as to make disassembly of the fastener difficult if not impossible. Since a plurality of fasteners are used depending on the size of the bucket, it is not unusual for at least one fastener of the plurality for each bucket to require removal by drilling, sawing or burning.

Moreover, it is often as economical to replace a damaged bucket with a new one since the heavy gauge material from which the buckets are made is usually stretched to a degree which necessitates heating and forging. It is for this reason that prior art implements such as that disclosed by C. F. Porter in his U.S. Pat. No. 1,620,920 is of little use on larger, heavy gauge buckets. While the Porter implement will correct diagonal racking of a bucket, it provides no correction of a stretched scraper or drag lip.

Additional prior art that may be relevant to the present invention is found in U.S. Pat. Nos. 2,010,713, 2,750,983 and 3,543,561.

What is desired, therefore, is a means whereby such buckets may be inexpensively reformed to a reasonably correct shape. Preferably, the desired means should perform the objective while the bucket remains mounted on the carrier belt thereby obviating the necessity to remove damaged fasteners.

SUMMARY OF THE INVENTION

This and other objects of the invention as perceived by those of ordinary skill are accomplished by a relatively light linear motor such as a portable hydraulic or screw jack connected between respective press platens. The press assembly is built about an elongated, rigid load carrying member characterized herein as a press bracket that is pivotally attached to a base platen at one end thereof and provides a seat base for the linear motor at the other end.

The base platen is secured tightly, as by two or more of the plurality of belt fasteners, to the damaged bucket along the inside face of the bucket mounting lip opposite from the drag lip. The press bracket extends over the bucket drag lip with the motor platen applied to the outside face of the drag lip adjacent to the press bracket.

A confining yoke is then clamped to the bucket drag lip on both lateral sides of the motor platen.

When the motor is extended, the force thereof is reacted against the bucket mounting lip to press the drag lip into proper alignment. Motor force misalignment which would otherwise cause the press bracket to expand away from the drag lip is resisted by the confining yoke.

BRIEF DESCRIPTION OF THE DRAWING

Relative to the drawing wherein like reference characters designate like or similar elements.

DESCRIPTION OF THE PREFERRED EMBODIMENT

Figure 1:
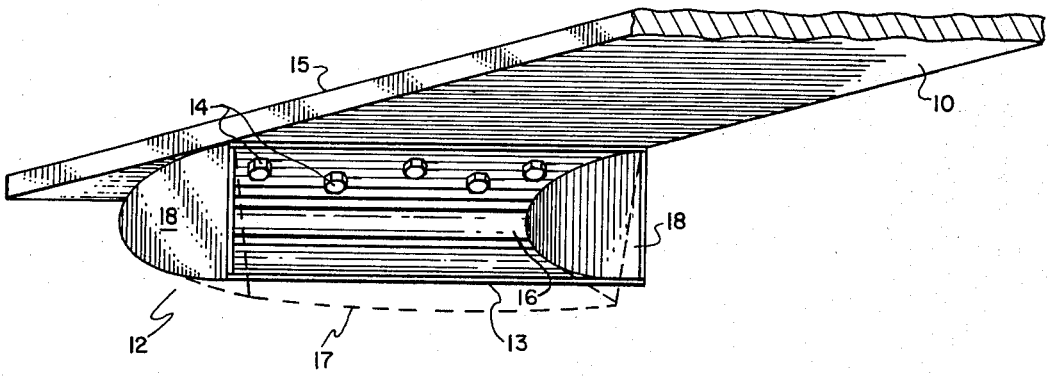
FIG. 1 is perspective illustration of a section of elevator bucket belt showing a mounted bucket of the type to which the utility of the present invention is directed.
Figure 3:
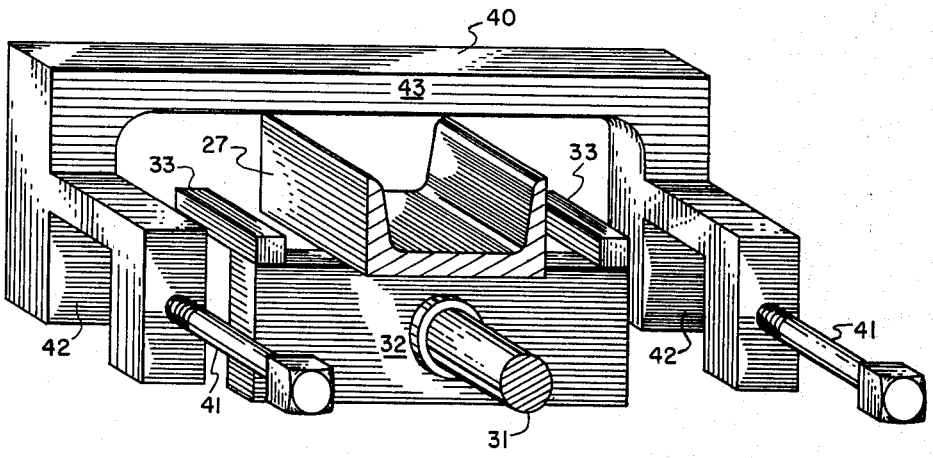
FIG. 3 is a perspective illustration of the confining yoke positioned over a section of the press bracket with the motor platen guided therebeneath.

With reference to FIG. 1 for orientation, bucket belt elevators essentially comprise an endless course of heavy, but stiffly flexible belting 10 to which a multiplicity of buckets 12 are secured thereabout. The belt course is directed through the bed of particulate material that is to be moved so that the drag lip 13 of the bucket cuts into the material bed.

Usually, such buckets are mounted to the belting by means of countersunk, flathead machine screws 14 inserted from the power transmission face 15 side of the belt. Consequently, the threaded shank and nut for the screw fasteners 14 project into the bucket interior through the bucket side wall 16 opposite from the drag lip 13.

As the bucket is used, it encounters objects and conditions which exceed the strength of the bucket material thereby causing a sharp distortion generally following that of the dashed outline 17. The net effect of such distortion is to draw the bucket ends 18 in at the drag lip corners and to draw the drag lip 13 out at the center between the ends.

Figure 2:
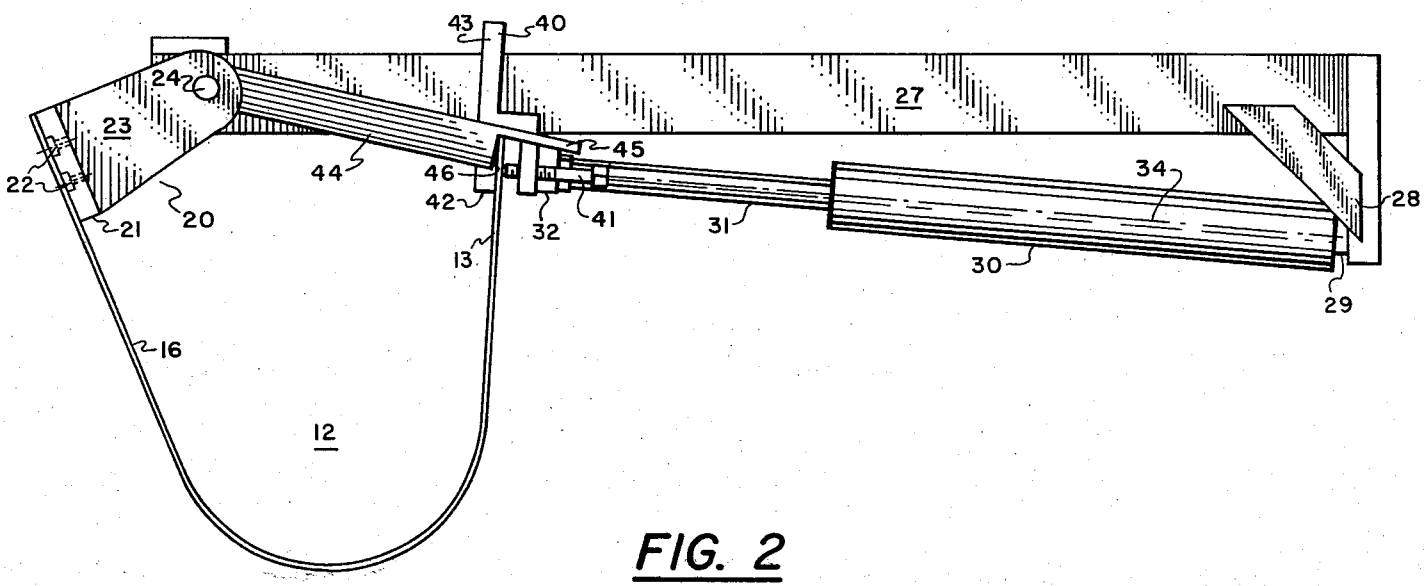
FIG. 2 is an orthographic projection of the present invention in operative assembled position on a bucket.
Figure 4:
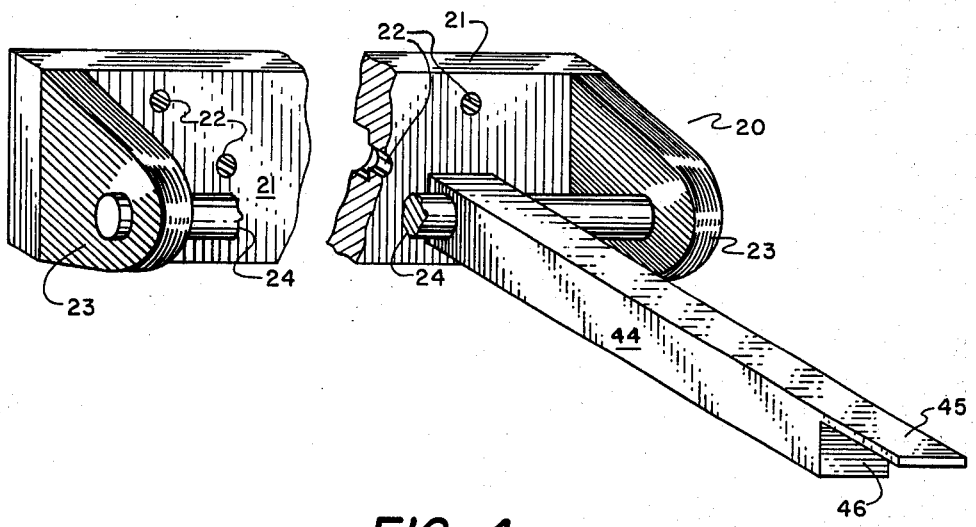
FIG. 4 is a sectionalized perspective of the base platen showing a portion of the bracket axle and one shaping bar.

The base platen structure 20 for attaching the present invention to a selected, misshapen bucket pursuant to reformation is illustrated by FIGS. 2 and 4 and comprises a base plate 21 having counterbored apertures 22 drilled in a pattern to match that of bucket mounting fasteners 14. The counterboring of these apertures 22 is of such depth and diameter as to permit the base plate 21 to be positioned flush with the bucket mounting side wall 16 without removal of any particular fastener 14 nut. Consequently, damaged fasteners may be left undisturbed as the platen is secured in position by the projection of those remaining fasteners 14 having undamaged threads.

Upstanding normally from the base plate 21 ends are a pair of axle mounts 23 drilled to receive an axle shaft 24.

Pivotally mounted at the axle shaft 24 center is one distal end of the press bracket 27 which may be conveniently fabricated from a length of structural channel. At the opposite distal end of the press bracket is a motor base plate 28 having a socket pin 29.

Although not illustrated, the bracket 27 may be of greater, continuous length and the motor base plate 28 may be of the sliding adjustability type that wedges to a desired position under cantilevered load.

The linear motor 30 may be of any suitable type such as a screw jack or hydraulic pressure extended piston and cylinder, the latter type being illlustrated by FIG. 2. To the motor ram 31 end is secured the motor platen 32 having a pair of alignment tabs 33.

Dimensionally, the straight line axis between the axle shaft 24 and the motor socket 29 should align as nearly as convenient with the force axis 34 of the motor 30.

To resist any unbalancing couple remaining in the set-up, a bracket confining yoke 40 is clamped, by means of machine screws 41, to the drag lip 13 with yoke legs 42 positioned on opposite sides of the motor platen 32. The yoke bight 43 spans between the clamped legs 42 to prevent rising of the press bracket 27 away from the drag lip 13 edge when the motor ram 31 is extended.

To prevent collapse of a bucket by excessively extending a motor ram 31, a pair of shaping bars 44 are pivoted at one end from the axle shaft 24 so as to flank the confining yoke legs 42. A glide extension 45 from the shaping bar free end is long enough to abut the bucket drag lip 13 in the distorted condition and thereby maintain correct positionment of the abutment face 46 throughout the restoration stroke of the motor ram 31.

Figure 5:
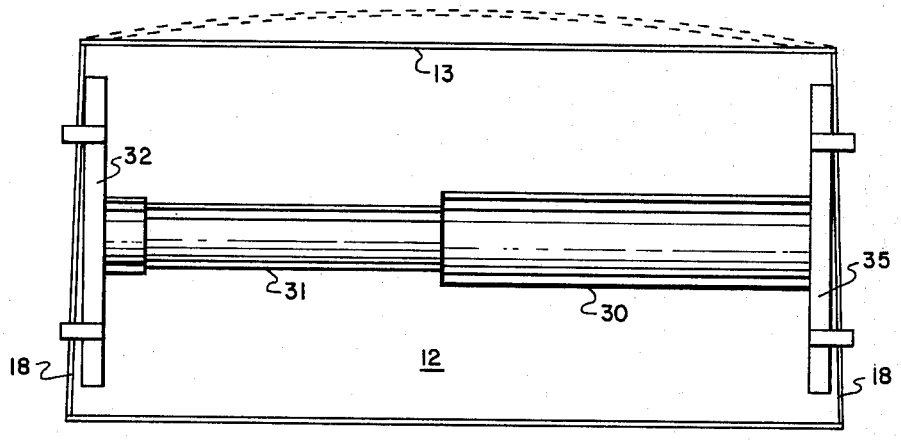
FIG. 5 is an orthographic plan projection, of the present invention positioned for the first step of the reformation process.

In operation, a distorted bucket 12 is first reformed longitudinally as FIG. 5 illustrates by fitting the motor cylinder base with a platen 35 similar to the motor platen 32 on the ram 31. When extended, the motor 30 will expand the bucket ends 18 to a flush, squared position with the platen faces: which is the desired shape. However, even when the ends 18 are restored to square, due to stretching of the drag lip 13, considerable distortion therein will remain. For this purpose, the apparatus of FIG. 2 is used.

To restore the drag lip 13, two or more undamaged bucket mounting fasteners 14 are selected to secure the base platen 20 to the bucket side wall 16. There is no requirement to remove the bucket from the belt 10.

With the base platen 20 in place, the press bracket 27 is positioned against the drag lip 13 and the confining yoke 40 positioned as shown and clamped by machine screws 41.

With the motor 30 in the collapsed condition, the motor platen 32 is positioned against the outside face of the drag lip 13 with the alignment tabs 33 resting against the edge. The motor 30 is then expanded until the cylinder base may be socketed over the pin 29.

Shaping bars 44 are then rotated into position with the glide extensions 45 resting against the drag lip 13 edge.

In this condition, the tool is completely aligned for final expansion of the motor 30 until the inner face of the drag lip 13 engages the shaping bar abutment faces 46 whereupon the bucket 12 shape is restored for use.

Having fully and completely described our invention, We claim:

1. A bucket shape restoration tool comprising:

A. An elongated, rigid load carrying member having a linear motor socket base secured thereto;

B. Base platen means secured to a first bucket wall and having a pivotal connection to one end of said elongated member;

C. Confining yoke means for confining said elongated member to a position transversely adjacent an edge of a second bucket wall opposite from said first wall, said yoke means having two leg means and interconnecting bight means, said leg means having second wall clamping means, said elongated member being confined between said bight means and said second wall edge;

D. Motor platen means for engaging said second wall in an area between said leg means and adjacent the edge transversing position of said elongated member; and, E. Expansible linear motor means disposed between said motor socket base and said motor platen means.

2. A tool as described by claim 1 wherein said base platen means comprises a base plate having spaced axle mounts projecting therefrom, said base plate having fastener apertures counterbored on a plate face thereof opposite from the projection of said axle mounts, said apertures and counterbores being of such dimension and pattern as to permit juxtaposition of said opposite plate face with said first bucket wall without removal of bucket fasteners.

3. A tool as described by claim 2 comprising an axle shaft extending through said axle mounts and said one end of said elongated member.

4. A tool as described by claim 3 further comprising motor stroke limiting means pivotally attached to said axle shaft, said limiting means having glide means to position a stroke limiting abutment face relative to said second wall.

* * * * *